US007839297B2

(12) United States Patent
Shih

(10) Patent No.: US 7,839,297 B2
(45) Date of Patent: Nov. 23, 2010

(54) REMOTE CONTROLLER FOR CONTROLLING PLAYBACK OF MULTIMEDIA FILE

(75) Inventor: Tzu-Chiang Shih, Taipei (TW)

(73) Assignee: Primax Electronics Ltd., Taipei (TW)

( * ) Notice: Subject to any disclaimer, the term of this patent is extended or adjusted under 35 U.S.C. 154(b) by 324 days.

(21) Appl. No.: 12/131,696

(22) Filed: Jun. 2, 2008

(65) Prior Publication Data

US 2009/0174567 A1 Jul. 9, 2009

(30) Foreign Application Priority Data

Jan. 4, 2008 (TW) ..... 97100399 A

(51) Int. Cl.
*G08B 5/00* (2006.01)

(52) U.S. Cl. ..... 340/815.6; 340/539.1; 340/689; 715/732; 345/158

(58) Field of Classification Search ..... 340/815.6, 340/539.1, 670, 689; 715/732; 345/158, 345/156
See application file for complete search history.

(56) References Cited

U.S. PATENT DOCUMENTS

2005/0212753 A1* 9/2005 Marvit et al. ..... 345/156
2006/0197745 A1* 9/2006 Yokozawa ..... 345/158
2007/0013775 A1* 1/2007 Shin ..... 348/114

* cited by examiner

*Primary Examiner*—Anh V La
(74) *Attorney, Agent, or Firm*—Kirton & McConkie; Evan R. Witt

(57) ABSTRACT

The present invention relates to a remote controller for controlling playback of multimedia files. The remote controller includes a controller body and a receiver. By changing the inclination statuses of the controller body and pressing down the button on the external surface of the controller body, the user can remotely control playback of the multimedia files. The multimedia file playback remote controller of the present invention is small in size and thus convenient for storage.

9 Claims, 3 Drawing Sheets

REMOTE CONTROLLER FOR CONTROLLING PLAYBACK OF MULTIMEDIA FILE

FIELD OF THE INVENTION

The present invention relates to a remote controller for controlling playback of a multimedia file, and more particularly to a remote controller for controlling playback of a multimedia file by detecting the user's gestures.

BACKGROUND OF THE INVENTION

Nowadays, personal computers have experienced great growth and are now rapidly gaining in popularity. Due to the amazing power of personal computers, personal computers are developed to have various functions. For example, the person computers are widely used for playing multimedia files. In addition, the person computers are used to make a presentation in a meeting. By incorporating a presentation program (e.g. PowerPoint) to edit and play slide files containing texts, pictures, images, songs or other effects, the lecturers or the presenters may directly display information in the form of a slide show. Alternatively, when a multimedia playback program is executed, the movies, song files and the like will be reproduced by the personal computer.

For facilitating the user to control playback of multimedia files, the manufactures have developed a variety of remote controllers for remote operations of the multimedia files. Typically, the remote controller for playing multimedia files includes a controller body and a receiver. The controller body may assert a playback control signal. The receiver is connected to the host computer for receiving the playback control signal and transmitting the playback control signal to the host computer for controlling playback of the multimedia files. For portability and storability, the controller body and the receiver are designed to have reduced volume. Moreover, the controller body can be combined with the receiver and stored in an external slot (e.g. a PCMCIA slot or an EXPRESS slot) of a notebook computer.

Generally, the main body of the remote controller has many buttons to be triggered to implement desired functions while playing the multimedia files. For example, by pressing down specified click buttons of the remote controller, "Page Down", "Page Up", "Slide Show" and "Blank" functions are executed accordingly. For meeting the ergonomic demand of pressing the button by the user's thumb, all buttons need to have sufficient areas. In addition, as the number of buttons on the main body is increased, the operating modes of the remote controller are increased and thus the remote controller is relative large in size. On the contrary, if the number of buttons on the main body is decreased and the size of the remote controller is reduced, the operating modes of the remote controller are decreased. As a consequence, when the remote controller is designed, the purpose of decreasing the button number and the purpose of reducing the size of the main body are compromised.

Therefore, there is a need of providing a remote controller capable of controlling playback of a multimedia file in many operating modes, in which the remote controller is small in size and thus convenient for storage.

SUMMARY OF THE INVENTION

It is an object of the present invention to provide a remote controller for controlling playback of a multimedia file in many operating modes. The remote controller is small in size and thus convenient for storage.

In accordance with an aspect of the present invention, there is provided a multimedia file playback remote controller for controlling playback of a multimedia file in a computer. The multimedia file playback remote controller includes a controller body and a receiver. The controller body asserts a playback control signal for controlling playback of the multimedia file, and includes a motion sensor, a button, a processor and a wireless emitter. The motion sensor is disposed inside the controller body for detecting an inclination status of the controller body and asserting a motion identification signal corresponding to the inclination status. The button is disposed on an external surface of the controller body and asserts a triggering signal when the button is pressed down. The processor is electrically connected to the motion sensor and the button, and asserts the playback control signal when the motion identification signal and the triggering signal are received by the processor. The wireless emitter is electrically connected to the processor and emits the playback control signal in a wireless transmission manner. The receiver is communicated with the computer for receiving the playback control signal emitted by the wireless emitter so as to control playback of the multimedia file.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
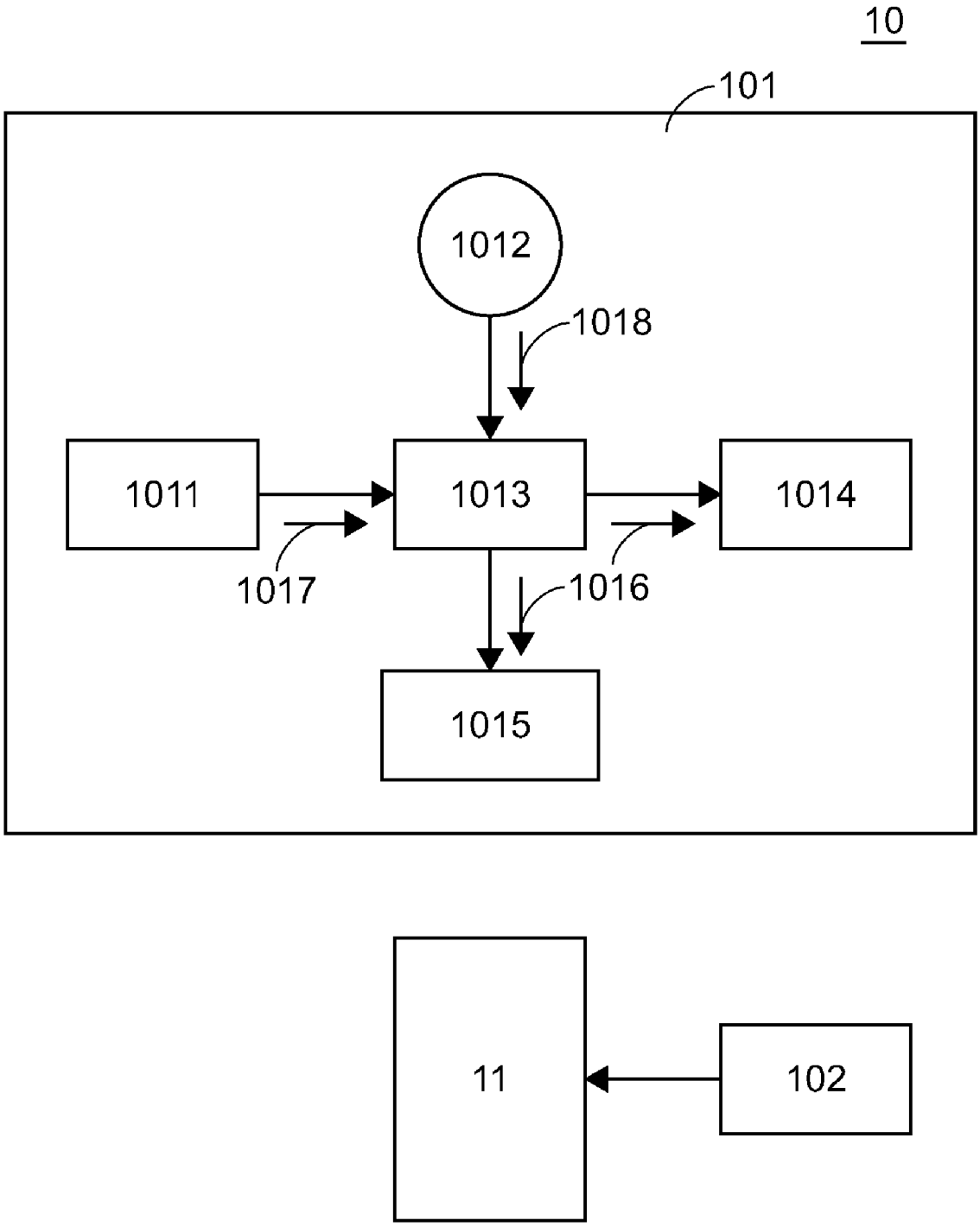
FIG. 1 is a schematic functional block illustrating a remote controller for controlling playback of multimedia files according to a preferred embodiment of the present invention.

FIG. 1 is a schematic functional block illustrating a remote controller for controlling playback of multimedia files according to a preferred embodiment of the present invention. The remote controller 10 of FIG. 1 principally includes a controller body 101 and a receiver 102. The controller body 101 may assert a playback control signal 1016 for controlling playback of multimedia files in the host computer 11. The controller body 101 includes a motion sensor 1011, a button 1012, a processor 1013, a wireless emitter 1014 and a laser light emitting element 1015. An example of the motion sensor 1011 includes an accelerometer. The receiver 102 is communicated with the host computer 11 for receiving the playback control signal 1016 and transmitting the playback control signal 1016 to the host computer 11 for controlling playback of the multimedia files.

The motion sensor 1011 is disposed inside the controller body 101 for detecting the inclination status of the controller body 101 and asserts a motion identification signal 1017. The button 1012 is disposed on the external surface of the controller body 101. When the user touches the button 1012, a triggering signal 1018 is asserted. The processor 1013 is electrically connected to the motion sensor 1011 and the button 1012. When the motion identification signal 1017 and the triggering signal 1018 are received by the processor 1013, a corresponding playback control signal 1016 is asserted from the processor 1013. The wireless emitter 1014 is electrically connected to the processor 1013. The wireless emitter 1014 receives the playback control signal 1016 from the processor 1013 and then emits the playback control signal 1016 in a wireless transmission manner. The receiver 102 will receive the playback control signal 1016 emitted by the wireless emitter 1014 and transmit the playback control signal 1016 to the host computer 11 connected thereto for controlling playback of the multimedia files. The laser light emitting element 1015 is electrically connected to the processor 1013. Optionally, in a case that the controller body 101 lies in a horizontal status, the motion sensor 1011 can assert a horizontal motion identification signal 1017. In response to the horizontal motion identification signal 1017 and a triggering signal 1018 generated from touch of the button 102, the processor 1013 asserts the playback control signal 1016 to the laser light emitting element 1015. In response to the playback control signal 1016, the laser light emitting element 1015 emits a laser light beam.

Figure 2:
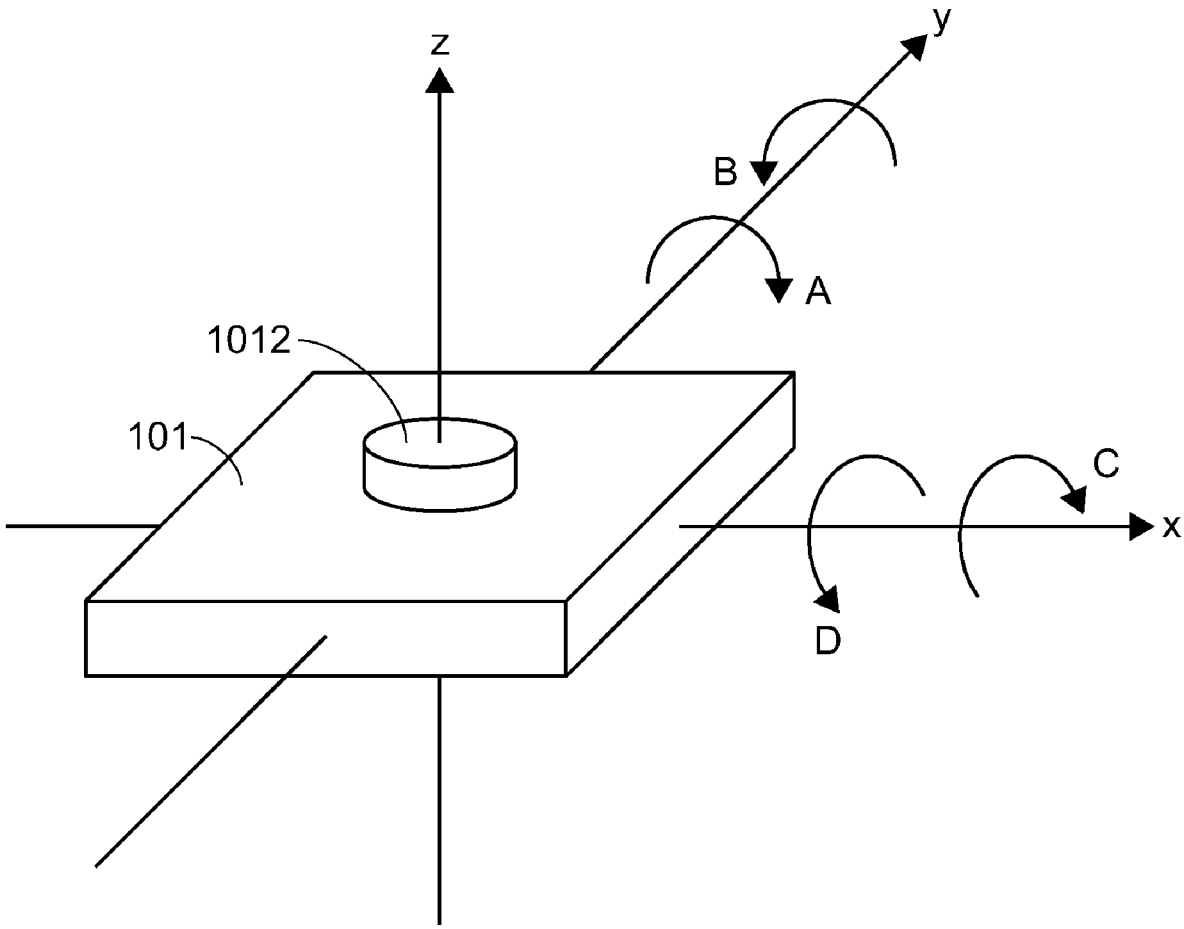
FIG. 2 is a three dimensional coordinate system indicating some possible inclination statuses of the controller body.

FIG. 2 is a three dimensional coordinate system indicating some possible inclination statuses of the controller body 101. Depending on the user's gestures of holding the controller body 101, the inclination statuses of the controller body 101 are changed. In the three dimensional coordinate system, the x-, y-, and z-coordinates of a point can also be taken as the distances from the yz-plane, xz-plane, and xy-plane respectively. As shown in FIG. 2, if the controller body 101 is parallel to the xy-plane, the controller body 101 is in a horizontal status. When the motion sensor 1011 inside the controller body 101 detects the horizontal status of the controller body 101, a horizontal motion identification signal 1017 is asserted from the motion sensor 1011 to the processor 1013. In addition, if the controller body 101 in the horizontal status is rotated at a specified angle in the direction as indicated by the arrow A with respect to the y-axis, the controller body 101 is in a rightward inclination status. When the motion sensor 1011 inside the controller body 101 detects the rightward inclination status of the controller body 101, a rightward motion identification signal 1017 is asserted from the motion sensor 1011 to the processor 1013. In addition, if the controller body 101 in the horizontal status is rotated at a specified angle in the direction as indicated by the arrow B with respect to the y-axis, the controller body 101 is in a leftward inclination status. When the motion sensor 1011 inside the controller body 101 detects the leftward inclination status of the controller body 101, a leftward motion identification signal 1017 is asserted from the motion sensor 1011 to the processor 1013. Likewise, if the controller body 101 in the horizontal status is rotated at a specified angle in the direction as indicated by the arrow C with respect to the x-axis, the controller body 101 is in a forward inclination status. When the motion sensor 1011 inside the controller body 101 detects the forward inclination status of the controller body 101, a forward motion identification signal 1017 is asserted from the motion sensor 1011 to the processor 1013. If the controller body 101 in the horizontal status is rotated at a specified angle in the direction as indicated by the arrow D with respect to the x-axis, the controller body 101 is in a backward inclination status. When the motion sensor 1011 inside the controller body 101 detects the backward inclination status of the controller body 101, a backward motion identification signal 1017 is asserted from the motion sensor 1011 to the processor 1013. In this embodiment, the specified angle is greater than zero degree and smaller than 90 degree.

Hereinafter, an embodiment of using the remote controller 10 for playing a slide file will be illustrated with reference to FIGS. 1 and 2. For playing a slide file and projecting a laser light beam onto the screen showing the contents of the slide file, the controller body 101 is adjusted to be in a horizontal status and then the button 102 is pressed down. When the controller body 101 lies in the horizontal status, the motion sensor 1011 inside the controller body 101 will assert a horizontal motion identification signal 1017 to the processor 1013. When the button 102 is pressed down, a triggering signal 1018 is generated and asserted to the processor 1013. In response to the horizontal motion identification signal 1017 and the triggering signal 1018, the processor 1013 asserts a playback control signal 1016 to the laser light emitting element 1015. In response to the playback control signal 1016, the laser light emitting element 1015 emits a laser light beam.

For executing a "Page Down" function to have the slide forward to the next page, the controller body 101 is adjusted to be in a leftward inclination status and then the button 102 is pressed down. When the motion sensor 1011 inside the controller body 101 detects the leftward inclination status of the controller body 101, a leftward motion identification signal 1017 is asserted to the processor 1013. When the button 102 is pressed down, a triggering signal 1018 is generated and asserted to the processor 1013. In response to the leftward motion identification signal 1017 and the triggering signal 1018, the processor 1013 asserts a playback control signal 1016 corresponding to a "Page Down" instruction to the wireless emitter 1014. Then, the playback control signal 1016 is emitted from the wireless emitter 1014 and received by the receiver 102. The playback control signal 1016 is then transmitted to the host computer 11 for controlling the slide forward to the next page.

Similarly, when the controller body 101 is adjusted to be in a rightward inclination status and then the button 102 is pressed down, a playback control signal 1016 corresponding to a "Page Up" instruction is executed to have the slide backward to the previous page. Similarly, when the controller body 101 is adjusted to be in a forward inclination status and then the button 102 is pressed down, a playback control signal 1016 corresponding to a "Slide Show" instruction is executed to display a series of chosen slides. Similarly, when the controller body 101 is adjusted to be in a backward inclination status and then the button 102 is pressed down, a playback control signal 1016 corresponding to a "Blank" instruction is executed to blank the screen.

The above embodiment is illustrated by referring to remote controller 10 for playing multimedia files. Nevertheless, the remote controller 10 of the present invention can be applied to control playback of one or more video files. The statuses of the controller body 101 are not limited to the operating instructions "Page Down", "Page Up", "Slide Show" and "Blank". Moreover, the operating instructions corresponding to the statuses of the controller body 101 can be predetermined according the manufacturer's design. For example, in a case that the multimedia file is a single video file, the playback control signal 1016 can be executed to control several functions including playback, pause, stop, volume up, volume down, fast forward, fast backward and so on. In a case that the multimedia files include multiple video files, the playback control signal 1016 can also be executed to control the "Previous file" function or the "Next file" function. Moreover, by increasing the statuses of the controller body 101, the operating instructions of the remote controller 10 can be added. For example, when the user shakes the controller body 101, the controller body 101 lies in a shaking status to assert a playback control signal corresponding to another operating instruction. In addition, if the controller body 101 in the horizontal status is rotated at 180 degree with respect to the y-axis, the controller body 101 is in an upside-down status to assert a playback control signal corresponding to a further operating instruction.

Figure 3:
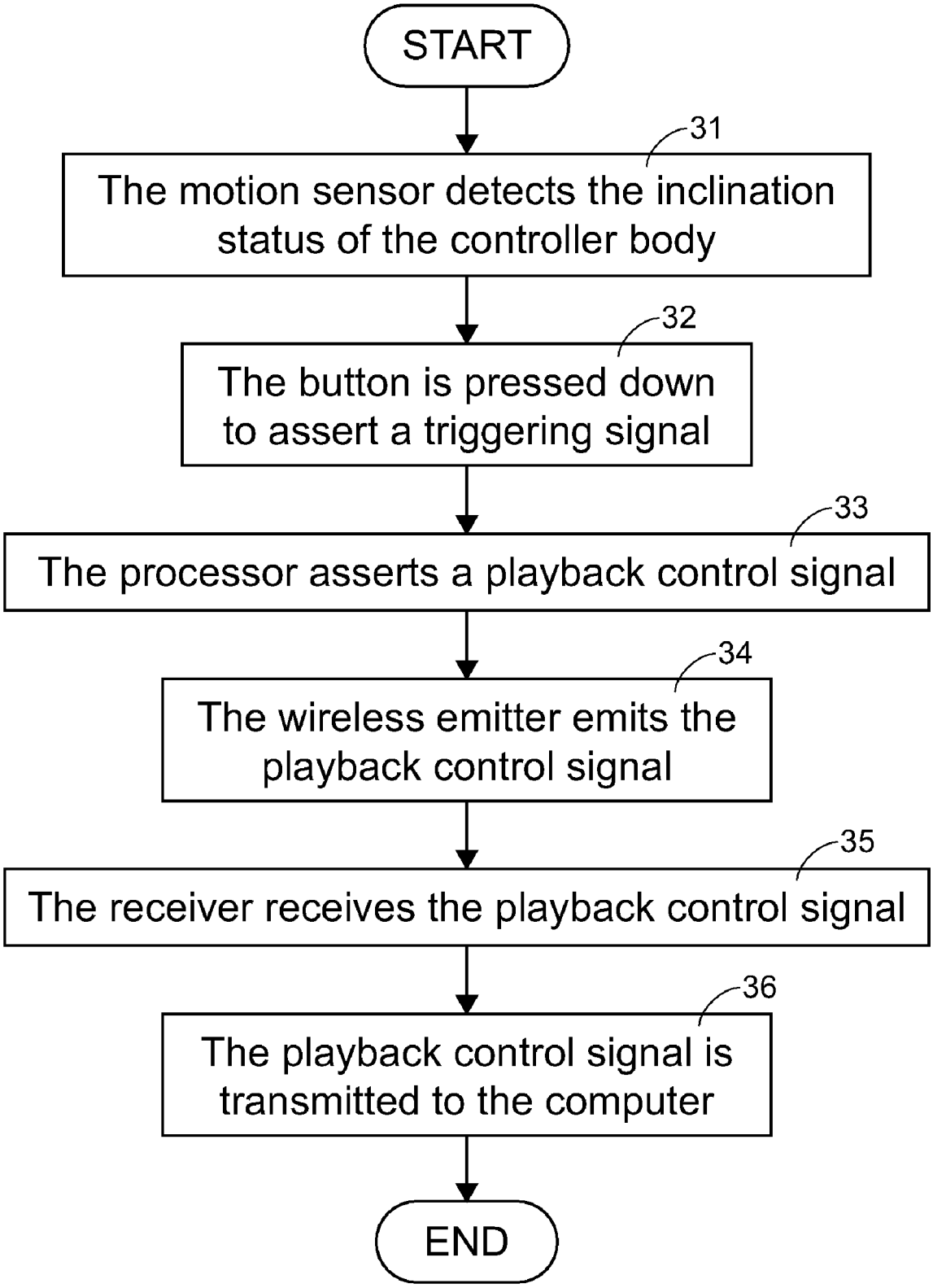
FIG. 3 is a flowchart illustrating operations of the remote controller of the present invention.

FIG. 3 is a flowchart illustrating operations of the remote controller 10. First of all, the motion sensor 1011 inside the controller body 101 detects the inclination status of the controller body 101 and asserts a motion identification signal 1017 corresponding to the inclination status (Step 31). Then, the button 1012 is pressed down to assert a triggering signal 1018 (Step 32). After the motion identification signal 1017 and the triggering signal 1018 are received by the processor 1013, a corresponding playback control signal 1016 is asserted from the processor 1013 (Step 33). After the wireless emitter 1014 receives the playback control signal 1016 from the processor 1013, the wireless emitter 1014 emits the playback control signal 1016 in a wireless transmission manner (Step 34). Afterwards, the receiver 102 receives the playback control signal 1016 emitted by the wireless emitter 1014 (Step 35) and transmit the playback control signal 1016 to the host computer 11 for controlling playback of the multimedia files (Step 36).

From the above description, the remote controller of the present invention is capable of controlling playback of multimedia files in many operating modes by changing the inclination statuses of the controller body and pressing down the button on the external surface of the controller body. As a consequence, the remote controller of the present invention is small in size and thus convenient for storage. Moreover, the remote controller of the present invention can achieve both of the purposes of decreasing the button number and reducing the size of the main body.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A multimedia file playback remote controller for controlling playback of a multimedia file in a computer, said multimedia file playback remote controller comprising:

a controller body asserting a playback control signal for controlling playback of said multimedia file, and comprising:

a motion sensor disposed inside said controller body for detecting an inclination status of said controller body and asserting a motion identification signal corresponding to said inclination status;

a button disposed on an external surface of the controller body and asserting a triggering signal when said button is pressed down;

a processor electrically connected to said motion sensor and said button, and asserting said playback control signal when said motion identification signal and said triggering signal are received by said processor; and a wireless emitter electrically connected to said processor and emitting said playback control signal in a wireless transmission manner; and a receiver communicated with said computer for receiving said playback control signal emitted by said wireless emitter so as to control playback of said multimedia file.

2. The multimedia file playback remote controller according to claim 1 wherein said controller body further comprises a laser light emitting element, which is electrically connected to said processor and emits a laser light beam when said controller body is in a horizontal status and said triggering signal is received.

3. The multimedia file playback remote controller according to claim 1 wherein said motion sensor is an accelerometer.

4. The multimedia file playback remote controller according to claim 1 wherein said inclination status of said controller body includes a horizontal status, a rightward inclination status, a leftward inclination status, a forward inclination status or a backward inclination status.

5. The multimedia file playback remote controller according to claim 4 wherein said multimedia file is a slide file.

6. The multimedia file playback remote controller according to claim 5 wherein said playback control signal corresponds to a "Page Up" instruction executable to have a slide backward to the previous page when said controller body is in a rightward inclination status, said playback control signal corresponds to a "Page Down" instruction executable to have a slide forward to the next page when said controller body is in a leftward inclination status, said playback control signal corresponds to a "Slide Show" instruction executable to display a series of chosen slides when said controller body is in a forward inclination status, and said playback control signal corresponds to a "Blank" instruction executable to blank the screen when said controller body is in a backward inclination status.

7. The multimedia file playback remote controller according to claim 4 wherein said motion sensor disposed inside said controller body further detects a shaking status and an upside-down status of said controller body.

8. The multimedia file playback remote controller according to claim 7 wherein said multimedia file includes one or more video files.

9. The multimedia file playback remote controller according to claim 8 wherein said playback control signal is executable to control playback, pause, stop, volume up, volume down, fast forward or fast backward function if said multimedia file includes a single video file, and said playback control signal is executable to control "Previous file" or "Next file" function if said multimedia file include multiple video files.

* * * * *